US006460611B2

(12) United States Patent
Zaoralek

(10) Patent No.: US 6,460,611 B2
(45) Date of Patent: Oct. 8, 2002

(54) ROLL FOR THERMAL AND MECHANICAL TREATMENT OF A WEB-SHAPED PRODUCT

(75) Inventor: Heinz-Michael Zaoralek, Königsbronn (DE)

(73) Assignee: Schwäbische Hüttenwerke GmbH, Aalen-Wasseralfingen (DE)

( * ) Notice: Subject to any disclaimer, the term of this patent is extended or adjusted under 35 U.S.C. 154(b) by 31 days.

(21) Appl. No.: 09/728,273

(22) Filed: Dec. 1, 2000

(65) Prior Publication Data

US 2001/0004933 A1 Jun. 28, 2001

(30) Foreign Application Priority Data

Dec. 1, 1999 (DE) ..... 199 57 8477

(51) Int. Cl.[7] ..... E28E 5/02
(52) U.S. Cl. ..... 165/89; 165/135; 165/96
(58) Field of Search ..... 165/89, 96, 135; 492/46, 47; 34/124, 119

(56) References Cited

U.S. PATENT DOCUMENTS

| | | | | |
|---|---|---|---|---|
| 3,406,748 A | * | 10/1968 | Jarreby | 165/89 |
| 4,503,626 A | | 3/1985 | Rothenbacher et al. | |
| 4,730,374 A | | 3/1988 | Neuhöffer et al. | |
| 5,180,002 A | * | 1/1993 | Schwarz | 165/89 |
| 5,285,844 A | * | 2/1994 | Schneid | 165/89 |
| 5,404,936 A | * | 4/1995 | Niskanen et al. | 165/135 |
| 5,899,264 A | * | 5/1999 | Marschke | 165/89 |

FOREIGN PATENT DOCUMENTS

| | | |
|---|---|---|
| CA | 2132935 | 6/1995 |
| DE | 30 14 891 | 10/1981 |
| DE | 31 40 425 | 4/1983 |
| DE | 35 18 808 | 11/1986 |
| DE | 42 44 812 | 6/1992 |
| DE | 43 43 172 | 1/1995 |
| DE | 195 13 500 C2 | 10/1996 |
| DE | 195 136 500 A1 | 10/1996 |
| GB | 2 314 605 | 1/1998 |

* cited by examiner

*Primary Examiner*—Henry Bennett
*Assistant Examiner*—Terrell McKinnon
(74) *Attorney, Agent, or Firm*—RatnerPrestia

(57) ABSTRACT

A roll for thermal and mechanical treatment of a web-shaped product, for example paper, comprises a roll body (1), thermal treatment conduits (2), insulating devices (4, 5; 4*a*, 5), a trunnion flange (3), and actuators (8). The insulating devices are capable of elongation in the thermal treatment conduits in the longitudinal direction of the conduits. The treatment conduits are for a thermal treatment fluid and are oriented in the roll body in the vicinity of the surface of the roll body. The trunnion flange is applied to the roll body, and the actuators are mounted in the trunnion flange and connected to the insulating devices. The actuators are mounted shiftable and fixable in the longitudinal direction of the thermal treatment conduits and are connected to the insulating devices for joint shifting.

24 Claims, 4 Drawing Sheets

ROLL FOR THERMAL AND MECHANICAL TREATMENT OF A WEB-SHAPED PRODUCT

BACKGROUND OF THE INVENTION

1. Technical Field

The invention relates to a roll for thermal and mechanical treatment of a web-shaped product, the roll comprising an elongatable thermal rim insulation.

It is regularly striven to construct heated or cooled rolls for thermal and mechanical treatment of web-shaped products so that the surface temperature is uniform over the full contact area. The shape of the roll is also required to remain as created at ambient temperature despite thermal expansion, this being the only way to also ensure that the pressure in the nip is uniform.

One particular problem in this respect is always the rim portion of the roll or, more precisely, the portion in which the web-shaped medium ends. It is here, for example, in heated rolls that the elevated reduction in heat by the web ends, and heat is given off to the environment only by convection and—usually negligible—radiation. Since this heat flow is significantly less than that in the web, the temperature increases in the surface portion of the roll having no web contact. Due to heat conduction beneath the surface of the roll, this increase in temperature usually extends also into the edge portion of the web, where it has a negative effect on the results of treatment.

This increase in temperature also involves thermal expansion of the roll diameter, resulting in a reduction in the nip in the edge portion of the paper web, where the specific pressure on the web increases and leads to a further negative effect on the results of treatment. If, in a paper calender, the web is overpressed at the ends in this way, the paper becomes thinner and loses its stiffness.

When the hot rim portion of a roll comes into contact with the companion roll, this may also result in damage if, for instance, the companion roll is coated with a temperature-sensitive flexible coating.

2. Description of Related Art

The measures proposed and also taken in attempting to solve the problems associated with rim heating are numerous. Correspondingly extensive is the prior art literature in this respect. For example, cited here is DE 31 40 425 regarding a roll having a shrink-fit positive displacer. It is intended that the heat flow be reduced from the heat transfer medium to the surface of the roll by an internal insulation. This reduces both the surface temperature and the expansion or so-called oxbow effect associated therewith in the rim portion.

In the case of rolls heated via a heat transfer medium flowing in axial-parallel conduits near to the surface of the rolls, rim insulation with higher heating performance has become prior art. In this case, the insulation is achieved by tubes or shells of an insulating material, such as, for example, Teflon, inserted in the edge portion of the conduits.

Since the expansion of the roll trunnion also affects the shape of the roll body in the rim portion, the insulation was also extended to the trunnion area of thermal treatment rolls, DE 35 18 808 C2 being an example of this. This requires, in general, that ovalization of the usually tubular roll body under linear pressure, the stiffening effect of the trunnion and the differing expansion coefficients of the materials, be carefully adapted to the measures taken in insulation.

Common to all of these means of optimization is that they can only be defined for a specific operating condition, i.e. as soon as the operating conditions such as, for example, the web width or the temperatures change, then the disadvantages cited at the outset reoccur more or less severely. Apart from this, taking into account all of the influencing factors involved is very difficult. Even after optimization there is often the need to adapt the dimensioning of the insulating measures as selected in design to the operating results as actually observed.

This is why there has been no lack of proposals to configure heating in the rim portion variable in order to also keep as much as possible to the optimum distribution of temperature and pressure given changes in the operating behavior.

Representative of this, a few proposals are cited from prior art in this respect.

Thus, it is proposed, for example, in DE 30 14 891 A1 to provide separate thermal treatment of the rim portions of heated rolls by means of separate heat transfer medium circuits. This idea presupposes the availability of rotary ducts having more than two connections when only one trunnion is available for the input and output of the heat transfer medium. As far as is known, no rotary ducts exist with the necessary cross-sections and the idea has never been put into actual practice.

In DE 43 43 172 C1, it is proposed for peripherally drilled thermal treatment rolls to provide several inputs for the heat transfer medium in the roll body, which intercept the peripheral drillings at various distances away from the rim. Using externally operable gate valves, the heat transfer medium can then be input and output at various distances away from the rim. However, such a variable rim heating was likewise never achieved, because weakening the highly loaded roll body in the rim portion by a plurality of communicating drillings is not without its problems.

In DE 31 40 425 A1, it is proposed, for a positive displacer roll, to employ an axially shiftable thermal insulating sleeve over a positioner guided outwards by means of a screw thread for thermally influencing the rim portion.

The same idea is to be found in DE 42 44 812 C2, however, for a peripherally drilled roll shell and, thus, applied to the insulating tubes used therein. As in DE 31 40 425, the intention is to provide external axial shifting of a sleeve of insulating material by rotating a positioner, guided externally, on which a screw thread is fitted.

However, to date, axially shiftable insulating sleeves—either in positive displacement rolls or in peripherally drilled rolls—have not entered practice.

The reason for this would seem to be the decisive sealing problem involved. Thus great care is taken to seal off the oil-guided portions from loss of the thermal oil in the case of modern thermal oil-heated rolls, in which the thermal oil is directed via distribution conduits in the trunnion flanges to the peripheral drillings. Such rolls are designed, more particularly, with double-acting sealing systems in which the oil needs to overcome two seals in sequence, before any leakage can occur. DE 42 44 812 C2 requires, for each side of each peripheral drilling, an additional sealed rotary duct to the exterior for the positioners.

Positioning the insulating sleeves in common at one side of the roll is not possible. Each sleeve needs to be moved individually. This is also the case in positioning the insulating ring on the positive displacer roll according to DE 31 40 425 A1, since a single adjusting screw would distort the ring.

Finally, there is no outward indication of the momentary positions of the individual axially shiftable insulating sleeves. It is thus easy to imagine that even minor negligence of the operating personnel and incomplete documentation of the positioning procedures may result in total disorientation as to the position of the sleeves, which can then only be established after having dismantled the roll trunnion.

Simply shifting the insulating sleeves is disadvantageous since a shift towards the middle of the roll exposes a non-insulated portion at the roll rim, resulting in the roll body being heated at a location where no heat is taken away.

Adjusting the thermal effect of the trunnion portion at the drive end of thermal treatment rolls is the subject matter of DE 195 13 500.8-12, Part of the heat transfer medium flow is directed through the central portion of the trunnion to enhance adapting the trunnion diameter to the changing operating temperatures via the heating in this portion, i.e. the shape of the roll in the rim portion is changed via the shape of the trunnion and not by the temperature of the roll body itself.

SUMMARY OF THE INVENTION

An object of the invention for a roll for thermal and mechanical treatment of a web-shaped product, comprising peripheral thermal treatment conduits for a thermal treatment fluid, is to achieve an elongatable rim insulation of the thermal treatment conduits which is reliably sealable and simple in design.

A roll, as defined by the invention, comprises a roll body having thermal treatment conduits for a thermal treatment fluid, which port at or in the vicinity of at least one face end of the roll body. The thermal treatment fluid may serve to heat or cool the roll shell and the web-shaped product. The thermal treatment conduits are oriented preferably in the axial direction of the roll body and are, more particular, preferably configured as axial peripheral drillings. Configured in a thermal treatment conduit at the end of the roll body by an insulating device is a thermal rim insulation between the thermal fluid flowing through the thermal treatment conduits and the roll body. The roll comprises furthermore a trunnion flange secured, preferably bolted, to the roll body. Mounted in the trunnion flange are actuators connected to the insulating devices. It is preferred that at least one insulating device is configured in each of the thermal treatment conduits, and even more preferred that an insulating device is configured in each thermal treatment conduit at each end of the roll body. However, it may be sufficient that an insulating device be configured only at an inlet end of each of the thermal treatment conduits or in only selected thermal treatment conduits, such as in every other thermal treatment conduit.

In accordance with the invention, each of the insulating devices is elongatable in the longitudinal direction of the thermal treatment conduits. Furthermore, each of the actuators is mounted shiftable in the trunnion flange and fixable relative to the direction of shifting. Each of the actuators is connected to a shiftable part of one of the insulating devices and entrains this part in its own shifting movement. The connection is preferably totally rigid and may be, for example, a weld. In principle, however, any connection for joint shifting will do.

The insulating devices themselves may be configured directly thermally insulating in that, as an insulating intermediate layer, they reduce any heat transfer between the thermal treatment fluid and the roll. However, they may also be configured so that, although permitting direct contact of the thermal treatment fluid with the conduit wall in the conduit portion to be insulated, they hinder the flow of the thermal treatment fluid, and, thus, likewise reduce the heat transfer between the thermal treatment fluid and the roll as compared to an unrestricted flow.

In preferred embodiments, the insulating devices are configured telescopic, including at least two elements being shiftably one relative to the other, preferably one of the elements being fixedly located in the corresponding thermal treatment conduit and forming a thermally insulating longitudinal portion of the insulating device, preferably a rim end portion, and the other element or elements may be shifted by means of the actuators, and, thus, is or are also termed shifting element or elements in the following. The insulating device being elongatable in itself may also be formed in that a longitudinal portion of the insulating device, preferably a rim end portion thereof, is formed directly by a portion of the thermal treatment conduit, into and out of which a shifting element is shiftable. Formed in the thermal treatment conduit is a low-flow insulating space, so-to-speak a dead space. Such an insulating space is preferably configured as a blind hole having no through-flow downstream of an inlet and/or an outlet. In both embodiments, the shifting element overlaps at least in one of its shifting positions, preferably in all shifting positions, a longitudinal portion of the insulating device formed by another element arranged in the thermal treatment conduit or by being correspondingly formed by flow engineering. In further preferred embodiments, each of the insulating devices may also be configured in one piece, more particularly as an insulating bellows of, for example, a thermally insulating material or of metal which is concertined in the longitudinal direction of the thermal treatment conduit. In such a one-piece configuration, preferably an end of the insulating device is fixedly located in the corresponding thermal treatment conduit, and another end forms a shifting element, which may be shifted by means of an actuator. The individual elements of each of the insulating devices act thermally insulating and/or flow-obstructing in all of the embodiments described above.

A thermally insulating longitudinal portion may be formed, as aforementioned, by an insulator insert, purely by flow engineering, or by a combination of both measures. When configured by means of an insulator insert, this insulator insert is made preferably of a thermally insulating material, such as, for example, Teflon or a ceramic material. The insulating longitudinal portion may also be formed, likewise preferably, by configuring an insulating space in the form of an insulating gap between the wall of the thermal treatment conduit and the insulator insert. Although the insulating gap is filled with thermal treatment fluid, it has no, or no unhindered, through-flow of the thermal treatment fluid. The insulating gap is thus cut off from the fresh inflow of hot or cold thermal treatment fluid. The advantage of this variant of the embodiment is that the insulator insert may be produced particularly cost-effective, for example made of steel. In a preferred variant, such an insulating gap is formed by means of an insert sleeve comprising at its outer shell a recess, this recess forming the insulating gap between the sleeve and inner wall of the thermal treatment conduit.

A shifting element may be made of a thermally insulating material, for example Teflon or a ceramic material, to line the thermal treatment conduit in shielding the wall of the thermal treatment conduit from the thermal treatment fluid. In a preferred variant, it is shaped such that it forms an insulating space with the wall of the thermal treatment conduit which, although it may be filled with thermal treatment fluid, has no, or no free, throughflow of thermal treatment fluid. In this case, it may also be made of a thermally insulating material, advantageously however, it may also be made of any other material which satisfies the mechanical and thermal requirements. Instead of this, the shifting element may also be used to steer the flow of the fresh thermal treatment fluid so that an open insulating space materializes at the wall of the thermal treatment conduit without any, or without any appreciable, flow velocity. Also due to this, the heat transfer from the freely flowing thermal treatment fluid to the roll is strongly reduced.

An advantage of the elongatable actuator is that the shifting position of the shiftable insulator insert is explicitly defined by the position of the actuator. The actuator serves, at the same time, as an indicator for the set length of the insulating device. The position of the actuator can be ascertained very simply by means of a depth gauge, with which the distance between a face of the trunnion flange and a rear face of the actuator is measured.

In a preferred example embodiment, a means for positioning the actuator is formed by a spindle drive. For this purpose, a positioning spindle is rotary mounted non-shiftable in the trunnion flange, a screw thread of the positioning spindle and a screw thread of the actuator forming the spindle drive. By rotating the positioning spindle the linearly guided actuator can be moved back and forth. It is particularly preferred that a drive gearwheel is seated on the positioning spindle, this drive gearwheel being connected by means of a transmission member to positioning spindles of further actuators for a common positioning drive. Preferably, the shifting elements of all devices are shifted by means of actuators having such a common drive at at least one side of the roll.

Although elongating the insulating device and, in particular, varying the insulating length by telescoping a shifting element relative to a thermally insulating longitudinal portion, preferably fixedly located, of the insulating device is particularly of advantage in conjunction with the pure shifting coupling between the actuator and the shifting element, it also already offers decisive advantages by itself. For instance, no space needs to be configured in the trunnion flange, into which a part of the insulating device is traveled. The Applicant reserves the right to direct a separate set of claims to elongation of the insulating device, also without the shifting coupling in accordance with the invention, although the combination affords specific advantages.

BRIEF DESCRIPTION OF THE DRAWINGS

The invention will now be detailed by way of preferred example embodiments with reference to the drawings in which.

DETAILED DESCRIPTION OF THE PREFERRED EMBODIMENTS

Figure 1:
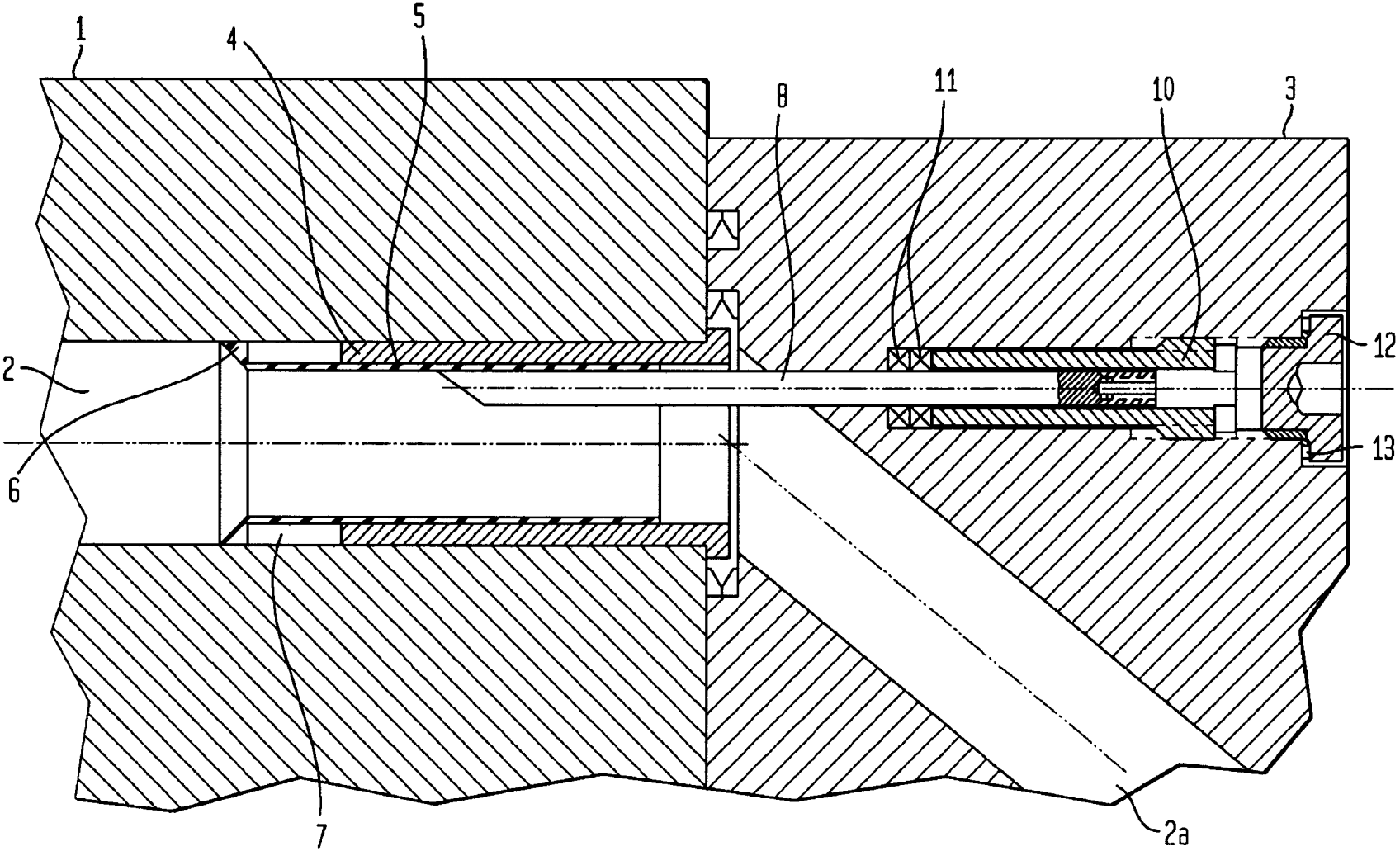
FIG. 1 is a longitudinal section view through an elongatable insulating device and a positioner in a first example embodiment.

FIG. 1 illustrates a rim portion of a roll in a longitudinal section view. The roll comprises a roll body 1 including axially peripheral drilled thermal treatment conduits 2, of which one conduit is shown as an example. Bolted to the face end of the roll body is a trunnion flange 3. The thermal treatment conduits 2 are configured as straight-forward drilled conduits so that the design at the opposite end of the roll body is the same as the one illustrated. The thermal treatment conduits 2 are oriented parallel to each other and to the surface of the roll and are evenly distributed around the circumference of the roll body 1. For each of the thermal treatment conduits 2, a separate elongatable insulating device and a positioner therefor is configured in the same way. Configured in the trunnion flange 3 in a known manner are fluid feeders 2*a*, extending radially inclined from a central rotation feeder, and leading to the peripheral thermal treatment conduits 2. Via these feeders, a thermal treatment fluid is directed to the thermal treatment conduits 2 and, after having passed through the thermal treatment conduits 2, is output at the opposite end of the roll body by a corresponding drain in one such trunnion flange. The thermal treatment conduits 2 thus port at both face ends of the roll body. Exemplary for the further thermal treatment conduits 2, an insulating device, forming a rim insulation of the thermal treatment conduit 2, will now be described by way of the thermal treatment conduit 2 as shown, it being understood that rim insulations and positioners of the same kind are likewise configured at the other end of the roll.

The insulating device is formed by a two-part insulator insert, consisting of an insulator insert 4 arranged non-shiftable in the thermal treatment conduit 2 and a shifting element 5. The shifting element 5 is shiftable in the thermal treatment conduit 2 and relative to the insulator insert 4. The shifting element 5 is a shiftable insulator insert, which shields the wall of the thermal treatment conduit 2 from the flow in the conduit. The non-shiftable insulator insert 4 forms a porting thermally insulating edge portion of the rim insulation. The non-shiftable insulator insert 4 is made of a thermally insulating material, preferably Teflon or a ceramic material. It is inserted pressurized up to a stop in the thermal treatment conduit 2 together with the shiftable insulator insert 5. The non-shiftable insulator insert 4 is a sleeve with a flange at one end, forming the stop upon insertion. The insulator insert 4 sealingly contacts the inner wall of the thermal treatment conduit 2 on all sides. It forms a material insulation, which permanently reduces a heat flow between the thermal treatment fluid and the roll body 1 over its length.

The shiftable insulator insert 5 is likewise configured as a sleeve. A shaft part of this sleeve is accommodated slidingly shiftable in the non-shiftable insulator insert 4. At a front end, protruding from the insulator insert 4, the insulator insert 5 is widened over its full circumference by a flange 6. The flange 6 protrudes by its full circumference until close to the inner wall of the thermal treatment conduit 2 without, however, obstructing sliding movement of the insulator insert 5, rather it also serves to guide the insulator insert 5. In an end position, the shiftable insulator insert 5 is inserted in the fixedly mounted insulator insert 4 by its flange up to the stop. Upon shifting the insulator insert 5 into the thermal treatment conduit 2, an insulating gap 7 is formed between the inner wall of the thermal treatment conduit 2 and the outer wall of the shaft part of the insulator insert 5, extending from the insulator insert 4. In the axial direction, the insulating gap 7 is defined by the flange 6 and a face side of the insulator insert 4 opposite the flange 6. The insulating gap 7 is not absolutely a tight seal, thus enabling it to be filled with thermal treatment fluid. It is however sufficiently sealed so that a flow through the insulating gap 7 does not occur. The thermal treatment fluid remaining in the insulating gap 7 after the gap length has been set or any gas bubble possibly formed therein upon lengthening of the insulating gap 7 forms a thermal insulation. The thermal insulation may also be formed only by the shaft part of the insulator insert 5, when the flange 6 is omitted. Even in such a configuration, any exchange of thermal treatment fluid in the open insulating gap 7 would be prevented or at least considerably reduced as compared to the flow downstream of the insulator insert 5.

An actuator 8 in the form of an actuator rod is non-shiftably connected to the shiftable insulator insert 5. In the example embodiment, the shiftable insulator insert 5 and the actuator 8 are connected to each other totally rigidly. For this purpose, the actuator 8 protrudes a little into the sleeve-shaped insulator insert 5, and is secured to the inner wall of the insulator insert 5. The actuator 8 is mounted shiftable in the trunnion flange 3, but locked against rotation around its longitudinal axis. This mounting arrangement is provided in a locating hole, passing through the trunnion flange 3 in a linear elongation of the thermal treatment conduit 2. In the assembled condition, the actuator 8 protrudes through a short section of the feeder for the thermal treatment fluid configured in the trunnion flange 3. Cross-sectionally, the actuator 8 is so thin that it obstructs the feed flow of the thermal treatment fluid and the through-flow of the thermal treatment conduit 2 only negligibly.

In the locating hole of the trunnion flange 3, in which the actuator 8 is mounted, a clamping spindle 10 and a clamp 11 are accommodated and arranged concentrically to the actuator 8. The clamping spindle 10 and the clamp 11, arranged at its front end, serve to define the actuator 8 in a shift position once set. At the rear free face end of the trunnion flange 3, the locating hole is sealed off by a plug 12. In the example embodiment, the plug 12 is screwed into the locating hole. Serving as a seal 13 is an O-ring sandwiched between a flange of the plug 12 and a companion surface area of the flange.

The clamp 11 may be configured as a gland, which together with the seal 13 in such a configuration would result in a double seal. Since the plug 12 is not mechanically loaded, only a single-acting seal 13 also suffices in principle.

To set the length of the rim insulation, the locating hole in the trunnion flange 3 is opened by releasing the plug 12. The actuator 8, and thus the shiftable insulator insert 5, may then be shifted axially. By extraction, for example with a screw part, screwed in an inner thread of the actuator 8, the effective insulating length can be shortened, it being lengthened by insertion. The exact shift position may be determined comfortably and with sufficient accuracy by application of a depth gauge from without, in that the position of the end of the actuator 8, relative to a defined rear face of the trunnion flange 3, is measured.

The shift position of the actuator 8 is fixed by the clamping means, including the clamping spindle 10 and clamp 11. By tightening the clamping spindle 10, the clamp 11 is actuated and fixedly holds the actuator 8 in the set shift position. After the actuator 8 has been set and clamped in place, the locating hole is again closed off fluid-tight by screwing in the plug 12. In this way, all actuators 8 and insulator inserts 5 of the roll are set individually.

Figure 2:
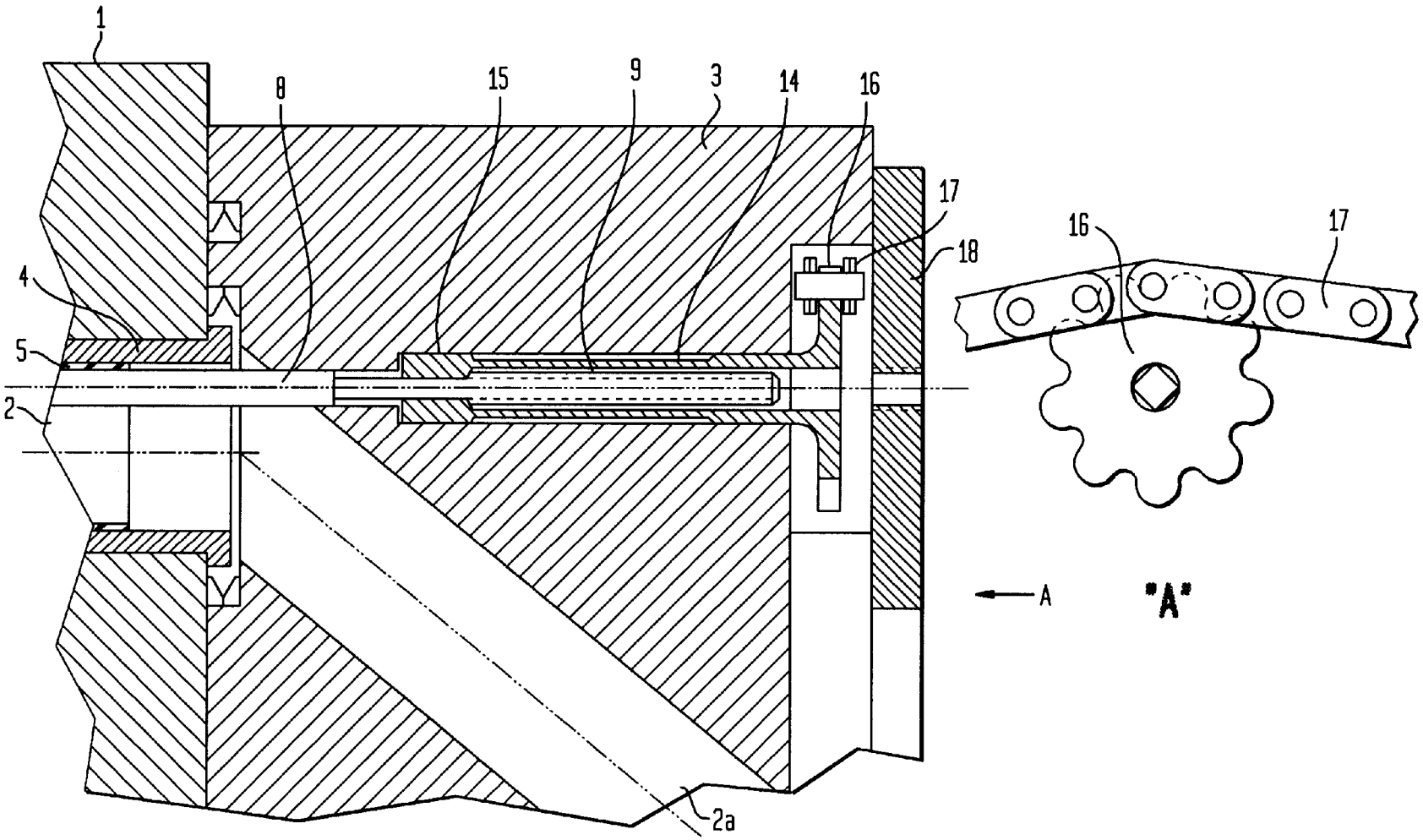
FIG. 2 is a longitudinal section view through a positioner in a second example embodiment.

A common setting of all shiftable insulator inserts 5 is explained by way of a single insulating device, as represented in FIG. 2, as an example. Except for the positioner for the shiftable insulator insert 5, the roll of the example embodiment of FIG. 2 is the same as the example shown in FIG. 1. In particular, the insulating device formed by the two insulator inserts 4 and 5 corresponds to the insulating device of the example embodiment shown in FIG. 1.

In this case too, the actuator 8 is again configured as an actuator rod, as in the example embodiment shown in FIG. 1. However, unlike the actuator shown in FIG. 1, the actuator 8 of FIG. 2 is provided with an outer thread 9 in a rear portion. In the region of the outer thread 9, the actuator 8 forms a spindle drive together with a positioning spindle, formed by a sleeve 14 with a threaded nut 15. The positioning spindle 14, 15 is rotary mounted non-shiftable in the locating hole and surrounds the actuator 8 concentrically. Seated at the front end of the positioning spindle is the threaded nut 15 in which the outer thread 9 of the actuator 8 runs. By rotating the positioning spindle 14, 15 around the longitudinal axis common to the actuator 8 and linear guide of the actuator 8, the shifting movement of the actuator 8, and thus of the insulator insert 5, is achieved. In this arrangement, the actuator 8 can be moved back and forth between two shifting end positions. As in the example embodiment shown in FIG. 1, the shiftable insulator insert 5 completely overlaps the non-shiftable insulator insert 4 in the one end position, and in the other end position it is telescopically extended, but is still guided at its rear end by a front end of the non-shiftable insulator insert 5.

By means of the positioning spindle 14, 15, a common drive for all actuators 8 of the trunnion flange 3 is formed. Seated on the positioning spindle 14, 15, at the rear end facing away from the threaded nut 15, is a drive gearwheel 16, which in the example embodiment is formed by a pinion. Each of the positioning spindles 14, 15 is securely connected against rotation relative to the others by one such drive gearwheel 16. The drive gearwheels 16 of all actuators 8 of the trunnion flange 3 are jointly driven by means of a circulating transmission member 17 in the form of a chain. A toothed belt may also serve as the transmission member, the drive gearwheels 16 would then accordingly be configured as toothed belt pulleys. However, a spur gear could also form a common drive, for example in the form of a central drive gearwheel mating with all drive gearwheels 16.

Each of the locating holes for the actuator 8 is flared at its rear end in order to mount one of the drive gearwheels 16. The locating holes and the entire positioner are sealed off by a sole end plate 18, for example a ring-shaped end plate. Detail "A" in FIG. 2 illustrates the locating hole with the sole opening in the end plate 18 for jointly positioning all actuators 8 and insulator inserts 5 of a roll end. The end plate 18 is sealed off from the trunnion flange, the opening being closed off tight by a plug. Since the end plate 18 and the plug do not need to handle any mechanical loads, a single-acting seal, in each case, is sufficient for sealing.

For positioning of the actuators 8, at least one of the positioning spindles 14, 15 is shaped in its rear opening such that by means of a positive torquing part, for example a square wrench, torquing is possible (detail "A"). Via the transmission member, torquing just one of the positioning spindles 14, positions all further positioning spindles 14, 15 in synchronism and thus all further actuators 8 and insulator inserts 5 in common. To access the positioner, a sole opening in the trunnion flange 3 suffices through which the positive torquing part is introduced into the outer end of the corresponding threaded spindle 14, 15. After having set or positioned the insulating length of the rim insulation, where necessary as checked with a depth gauge for instance, this sole opening in the trunnion flange 3 is resealed tight by a plug, for example the kind of plug 12 shown in FIG. 1.

As evident from the example embodiments, a further advantage of the invention to be emphasized is that most types of peripherally drilled thermal treatment rolls can be retrofitted with the rim insulation in accordance with the invention, since the modification of the trunnion flange 3 merely requires machining minor cross-sectional peripheral locating holes at locations which usually have no function whatsoever.

The non-shiftable insulator insert 4 is made of a thermally insulating material, preferably Teflon or a ceramic material, and the shiftable insulator insert 5 is preferably made of stainless steel, but may also be made of an insulating material, such as, for example, Teflon.

The insulating end portion, configured stationary in the thermal treatment conduit 2, in likewise preferred example embodiments is not, or at least not only, formed by a thermally insulating material, rather it is thermally insulated otherwise from the convection flow of the thermal treatment fluid. For this purpose, the insulating end portion, like the insulating gap 7 in the example embodiments shown in FIGS. 1 and 2, is configured as a non-flow or low-flow portion. In such an arrangement, an insulator insert, arranged non-shiftable in the thermal treatment conduit, may be made of any material, more particularly of stainless steel, which is dimensionally stable at the working temperatures of the thermal treatment fluid.

Three example embodiments for this arrangement will now be described merely by pointing out the differences in the previous example embodiments.

Figure 3:
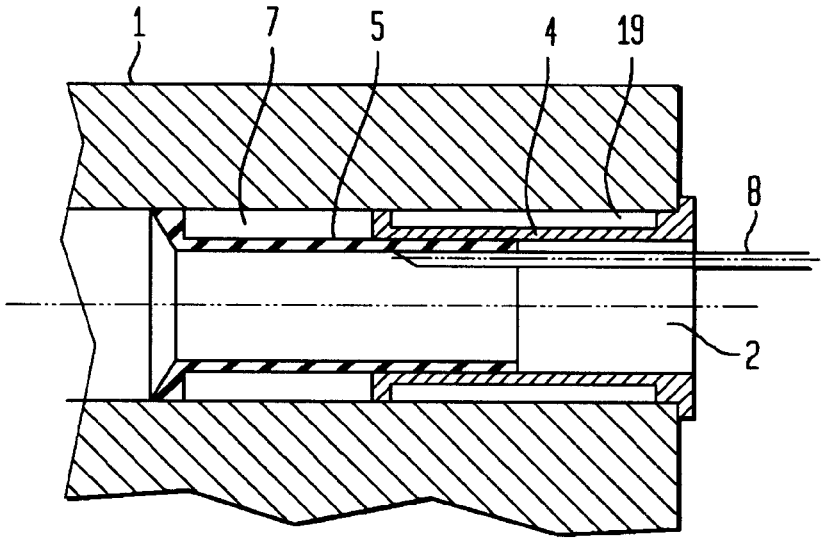
FIG. 3 is a longitudinal section view through an elongatable insulating device in a second example embodiment.

In the example embodiment of FIG. 3, a non throughflow insulating gap 19 is achieved between a non-shiftable insulator insert 4 and the inner wall of the thermal treatment conduit 2 by a recess of the outer shell surface area of the insulator insert 4. The shiftable insulator insert 5 corresponds in shape to that of the insulator insert 5 of the example embodiments shown in FIGS. 1 and 2. Preferred in this case is a shiftable insulator insert 5 made of a heat-insulating material, for instance an insulator insert 5 of Teflon.

Figure 4:
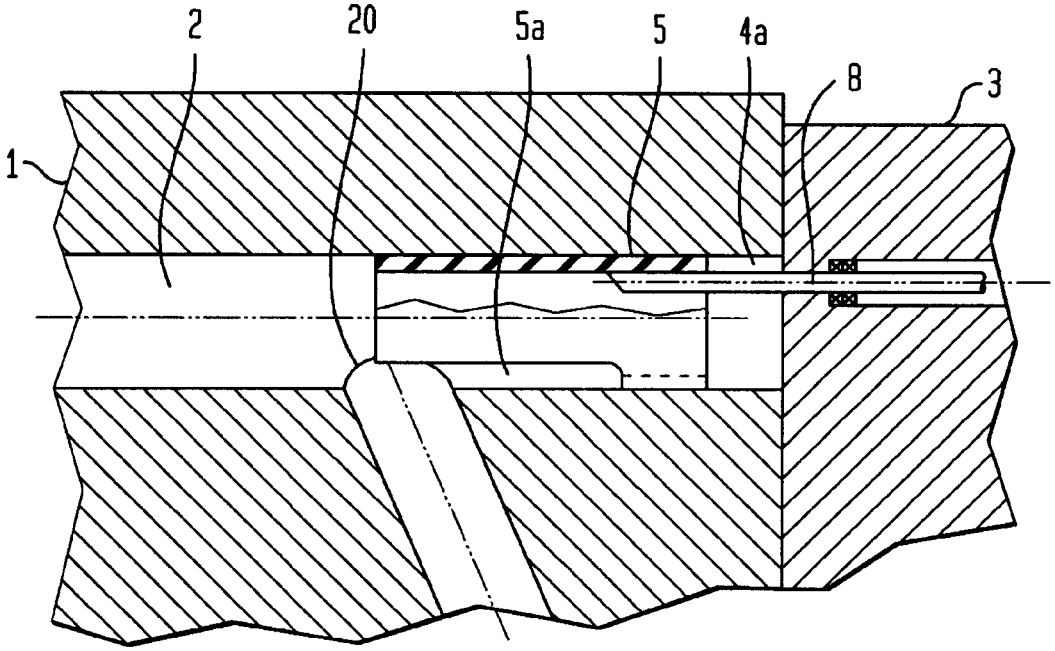
FIG. 4 is a longitudinal section view through an elongatable insulating device in a third example embodiment.

FIG. 4 depicts an example embodiment having only a single insulator insert 5, which is shiftable and made of a heat-insulating material, such as for example Teflon. The rear end portion 4*a* of the rim insulation is formed by an elongation of the thermal treatment conduit 2 by way of a blind hole.

The rear end portion 4*a* forms a flow dead space of the thermal treatment fluid. This is achieved in that the fluid feeder 2*a* does not port into the face end of the thermal treatment conduit 2, but rather somewhat apart of the face port of the drilling for the thermal treatment conduit 2. The thermally insulating end portion 4*a* is thus, in other words, formed by a portion of the thermal treatment conduit 2 elongating the thermal treatment conduit 2 beyond the inlet 20 of the fluid feeders 2*a*, contrary to the direction of flow of the thermal treatment fluid. In this way, an insulating space 4*a* arises, which has no through-flow or at least a low-flow, and forms the thermally insulated end portion. At an opposite, outlet end of the thermal treatment conduit 2, the thermal treatment conduit 2 is correspondingly elongated beyond a side outlet in the direction of flow, resulting in formation of a thermally insulated end portion, also at the opposite outlet end of the thermal treatment conduit.

The shiftable insulator insert 5 is as long as the portion of the thermal treatment conduit 2 elongated beyond the inlet 20. To change the length of the insulating device, the insulator insert 5 can be shifted from the elongated portion out of its rearmost shift position, in which it lines the elongated portion of the thermal treatment conduit 2, beyond the inlet 20 into the thermal treatment conduit 2, thus resulting in a telescopically elongatable insulating device having only a single insulator insert which is shiftable as a whole. In the circumferential portion in which the shiftable insulator insert 5 travels beyond the inlet 20 upon being shifted, it is provided with a longitudinal slot 5*a*. The longitudinal slot 5*a* may extend over the full length of the insulator insert 5 or starting from the front face of the insulator insert 5 only over the majority of the length. Even when the longitudinal slot 5*a* extends over the full length of the insulator insert 5, adequate thermal insulation to the surface of the roll body is still assured.

Figure 5:
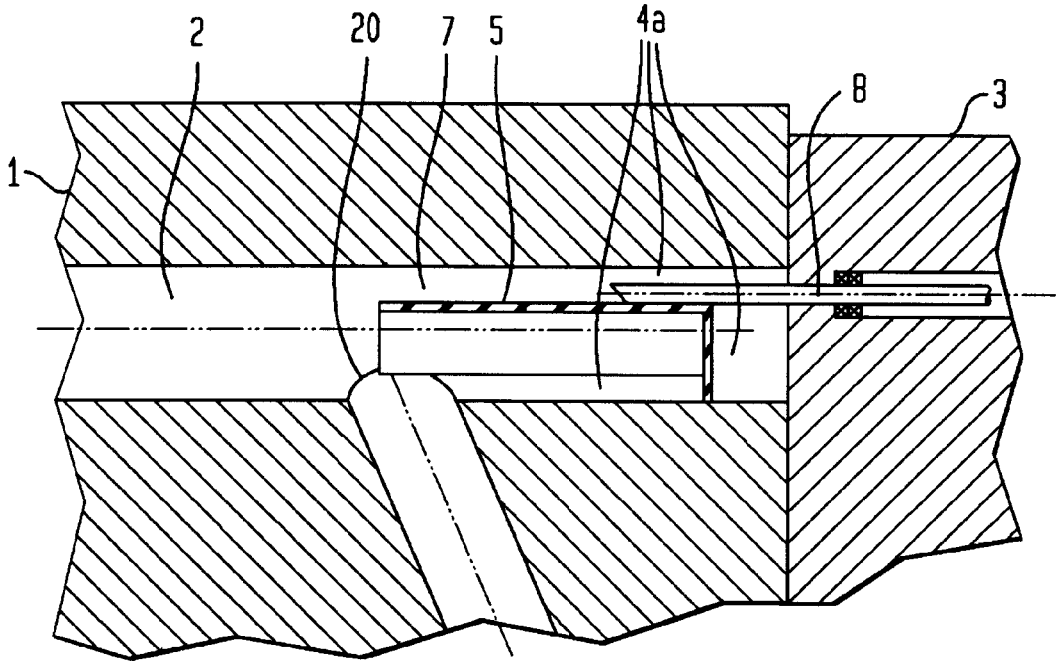
FIG. 5 is a longitudinal section view through an elongatable insulating device in a fourth example embodiment.

FIG. 5 illustrates an insulator device 4*a*, 5 in a modified form of the example embodiment shown in FIG. 4. In the example embodiment of FIG. 5, the insulator device 4*a*, 5 is formed only by flow-engineering measures. Lining the thermal treatment conduit 2 with a thermally insulating material does not occur. Instead, the thermal treatment fluid flowing from the inlet 20 in a radial direction into the thermal treatment conduit is deflected by the shifting element 5. For this purpose, the shifting element 5 is moved between the inlet 20 and the wall portion of the thermal treatment conduit 2 opposite the inlet 20. Thermal treatment fluid, freshly introduced into the thermal treatment conduit 2, thus first comes into direct thermal contact with the wall of the thermal treatment conduit 2 opposite the inlet 20 some distance downstream of the inlet 20.

As already described in the example embodiment of FIG. 4 there is permanently a thermally insulating end portion 4*a* in the form of a dead space behind the inlet 20. The shifting element 5 is shiftable from this thermally insulating end portion 4*a* beyond the inlet 20 deeper into the thermal treatment conduit 2. A further low-flow, insulating space 7 with adjustable length arises, which extends from the inlet 20 up to a front end of the shifting element 5.

The shifting element 5 comprises a deflecting or rebounding surface pointing in the longitudinal direction of the thermal treatment conduit 2 and a closure surface. The deflecting surface prevents a free flow onto the near surface portion of the wall of the thermal treatment conduit 2 by deflecting the flow. The deflecting surface extends over its full length transversely to the longitudinal direction of the thermal treatment conduit 2 on both sides towards the wall of the thermal treatment conduit 2. Preferably, it comes close to the wall on both sides. It is adapted at both sides to the wall of the conduit, but could also be simply plane and extend close to the conduit wall by its edges. The closure surface extends radially away from the deflecting surface at a rear end of the insulator insert 5 in the direction of the wall side of the thermal treatment conduit 2, at which the inlet 20 ports into the thermal treatment conduit 2. The closure surface extends to almost contact the wall of the thermal treatment conduit 2, the closure surface preventing thermal treatment fluid, held back by the deflection, from bypassing the deflector in the end portion 4*a* without obstruction.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

REFERENCE NUMERALS

| | |
|---|---|
| 1 | roll body |
| 2 | thermal treatment conduit |
| 2a | thermal treatment fluid feeder |
| 3 | trunnion flange |
| 4 | insulating longitudinal portion, non-shiftable insulator insert |
| 4a | insulating end portion, insulating space |
| 5 | shifting element, shiftable insulator insert |
| 6 | flange |
| 7 | insulating space, insulating gap |
| 8 | actuator, actuator rod |
| 9 | actuator thread |
| 10 | clamping spindle |
| 11 | clamp |
| 12 | plug |
| 13 | seal |
| 14 | sleeve |
| 15 | threaded nut |
| 16 | drive gearwheel, pinion |
| 17 | transmission member, chain |
| 18 | end plate |
| 19 | insulating space, insulating gap |
| 20 | inlet |

What is claimed is:

1. A roll for thermal and mechanical treatment of a web-shaped product comprising:

a roll body, thermal treatment conduits for a thermal treatment fluid which are oriented in the roll body in the vicinity of the surface of said roll body, at least one insulating device configured in said thermal treatment conduits such that, at one end of said roll body in said thermal treatment conduits, a thermal rim insulation is formed between the flowing thermal treatment fluid and said roll body, wherein said at least one insulating device is elongatable in said thermal treatment conduits in the longitudinal direction of said thermal treatment conduits, a trunnion flange applied to said roll body, and actuators mounted in said trunnion flange and connected to said insulating devices, wherein said actuators are mounted shiftable and fixable in the longitudinal direction of said thermal treatment conduits and are non-shiftably connected to said insulating devices for joint shifting.

2. The roll as set forth in claim 1, wherein said at least one insulating device comprises at least one thermally insulating longitudinal portion and at least one shifting element shiftable relative to said insulating longitudinal portion.

3. The roll as set forth in claim 2, wherein said thermally insulating longitudinal portion is formed by or with an insulator insert applied non-shiftable at the roll body end in a thermal treatment conduit.

4. The roll as set forth in claim 1, wherein said insulating device is formed by an elongatable insulator insert.

5. The roll as set forth in claim 1, wherein said at least one insulating device comprises at least one thermally insulating longitudinal portion in which an insulating space is configured having no throughflow of thermal treatment fluid.

6. The roll as set forth in claim 1, wherein said at least one insulating device comprises at least one thermally insulating longitudinal portion in which an insulating space is configured having no free throughflow of thermal treatment fluid.

7. The roll as set forth in claim 5, wherein said thermally insulating longitudinal portion is formed in a portion of said thermal treatment conduits which elongates said thermal treatment conduit beyond an inlet or outlet of a thermal treatment fluid feeder in the direction of one end of said roll body.

8. The roll as set forth in claim 1, wherein an insulating space having no throughflow of thermal treatment fluid is formed by a shifting element of said insulating device and the length of said insulating space is varied by shifting said shifting element.

9. The roll as set forth in claim 1, wherein an insulating space having no free throughflow of thermal treatment fluid is formed by a shifting element of said insulating device and the length of said insulating space is varied by shifting said shifting element.

10. The roll as set forth in claim 1, wherein a non-shiftable insulator insert of a thermally insulating material forms a thermally insulating longitudinal portion of said insulating device.

11. The roll as set forth in claim 1, wherein a non-shiftable insulator insert forming a thermally insulating longitudinal portion of said insulating device by configuring an insulating space having no throughflow of thermal treatment fluid is made of stainless steel.

12. The roll as set forth in claim 1, wherein a non-shiftable insulator insert forming a thermally insulating longitudinal portion of said insulating device by configuring an insulating space having no free throughflow of thermal treatment fluid is made of stainless steel.

13. The roll as set forth in claim 1, wherein a shifting element of said insulating device is made of a thermally insulating material.

14. The roll as set forth in claim 1, wherein said insulating device is formed by a bellows.

15. The roll as set forth in claim 1, wherein said actuators are rod-shaped and each is linearly mounted in a peripheral locating hole in said trunnion flange.

16. The roll as set forth in claim 1, wherein an adjusting position of an actuator relative to a locating hole, in which said actuator is mounted, can be measured through an opening of said locating hole.

17. The roll as set forth in claim 1, wherein a positioner for an actuator comprises a positioning spindle which is non-shiftable rotatably mounted in a locating hole of said trunnion flange, said spindle forming with said actuator a spindle drive for shifting said actuator.

18. The roll as set forth in claim 17, wherein said locating holes for said actuators port into a common flared portion in said trunnion flange, that said positioning spindles of said actuators carry drive gearwheels at their ends protruding into said flared portion, and that in said flared portion of said trunnion flange a transmission member produces common rotation of said positioning spindles of said actuators.

19. The roll as set forth in claim 18, wherein said flared portion configured in said trunnion flange is closed off tight by means of an end plate and that said end plate comprises at least one opening for passage of a turning part for one of said positioning spindles, said opening being tightly closable by means of a plug.

20. The roll as set forth in claim 10, wherein said thermally insulating material is Teflon or a ceramic material.

21. The roll as set forth in claim 13, wherein said thermally insulating material is Teflon or stainless steel.

22. The roll as set forth in claim 19, wherein said end plate comprises one opening.

23. The roll as set forth in claim 1, wherein said at least one insulating device is configured in each of said thermal treatment conduits.

24. The roll as set forth in claim 1, wherein said at least one insulating device is configured in some of said thermal treatment conduits.

* * * * *